United States Patent [19]

Pollock

[11] 4,342,286

[45] Aug. 3, 1982

[54] INTEGRAL ECONOMIZER STEAM GENERATOR

[75] Inventor: William H. Pollock, East Granby, Conn.

[73] Assignee: Combustion Engineering, Inc., Windsor, Conn.

[21] Appl. No.: 99,184

[22] Filed: Nov. 30, 1979

[51] Int. Cl.[3] ..... F22B 21/00

[52] U.S. Cl. ..... 122/336; 122/238; 122/352; 122/444

[58] Field of Search ..... 122/238, 336, 337, 352, 122/444, 472, 473, 94 R

[56] References Cited

U.S. PATENT DOCUMENTS

| | | | |
|---|---|---|---|
| 1,836,119 | 12/1931 | Huster | 122/336 |
| 2,065,559 | 12/1936 | Blodgett | 122/444 |
| 2,333,631 | 11/1943 | Bailey et al. | 122/336 |

*Primary Examiner*—Edward G. Favors
*Attorney, Agent, or Firm*—Edward L. Kochey, Jr.

[57] ABSTRACT

A bottom supported steam generator for burning solid fuel with a vertical tube bank connecting an upper steam drum with a lower water drum. Horizontal economizer tubes are interspersed between the vertical tubes of the steam generating bank.

3 Claims, 1 Drawing Figure

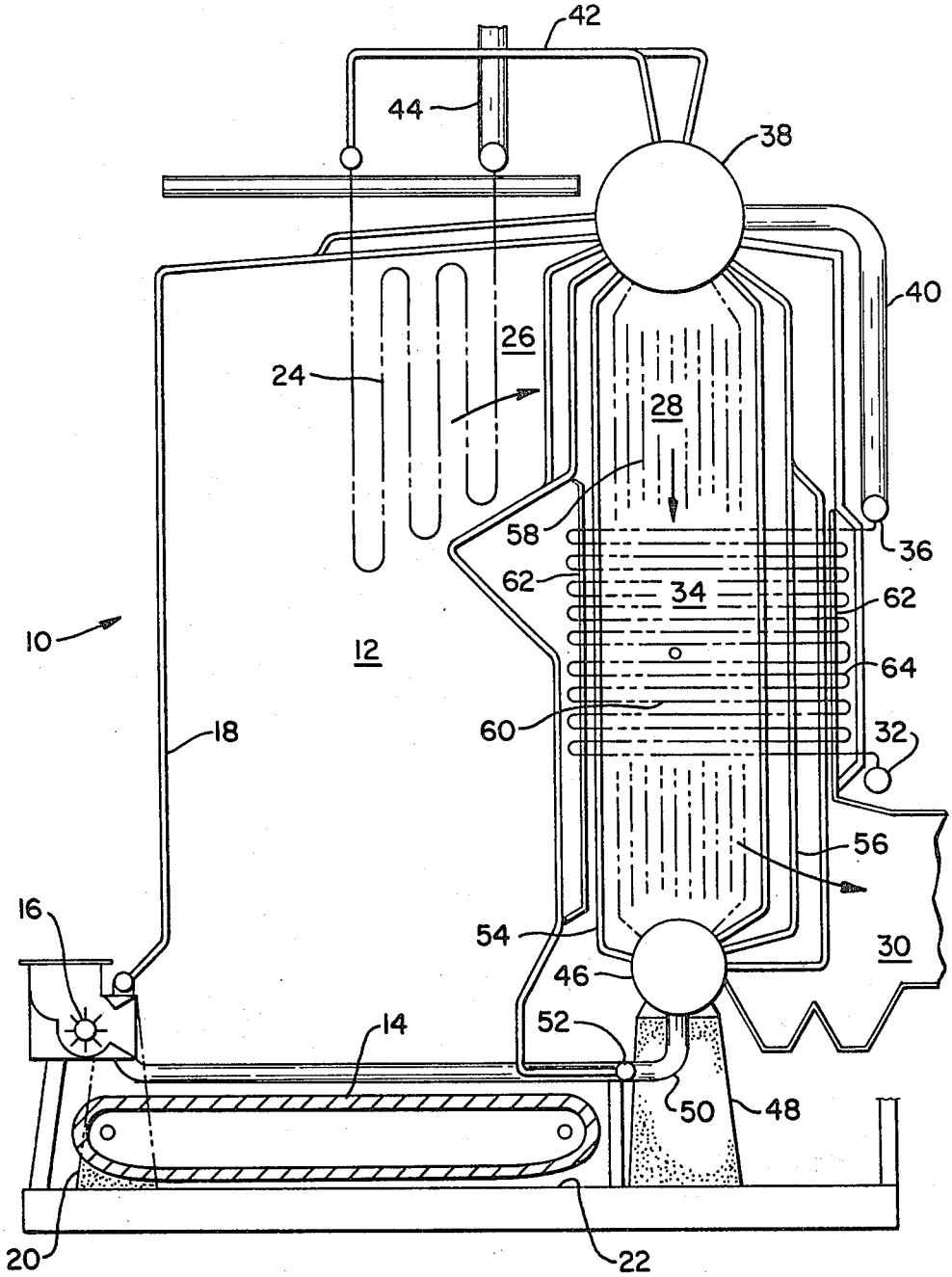
42
44
38
40
26
24
28
58
36
62
34
62
10
12
64
60
32
18
56
16
54
30
46
14
52
50
48
20
22

INTEGRAL ECONOMIZER STEAM GENERATOR

BACKGROUND OF THE INVENTION

This invention relates to bottom supported steam generators for burning solid fuel and in particular to an integral economizer arrangement therewith.

The burning of solid fuels in a steam generator yields a solid ash. At least a portion of this ash is carried with the flue gases past the tubing surfaces and through the ducts. These ash particles cause erosion on the surfaces and settle out at various locations with resultant plugging of the gas flow path.

Most boiler designs for burning solid fuels are top supported with separate grid steel or else they are bottom supported with the baffled steam generating bank. The baffled bank is a source of rapid tube erosion due to the abrasive action of the ash particles carried through the boiler by the flue gas.

Baffling of the steam generating bank produces cross flow of the gases across the tubes thereby increasing the heat transfer rates. This results in the smallest amount of tubing required; and, accordingly, the water drum for the convection bank tends to be supported at an intermediate elevation. The flowing gases must then be conducted outside of the steam generating area to an economizer. Furthermore, experience has shown that horizontal gas flow through economizers tends to result in ash build up and blockage of the tubes. Accordingly, additional ducting is required to achieve vertical downflow through an externally located economizer.

SUMMARY OF THE INVENTION

A bottom supported steam generator for burning solid fuel has a steam drum supported at an upper elevation and a water drum which is supported at a lower elevation near the lower support of the furnace. A plurality of tubes connect the water drum and the steam drum with a portion of these forming the front wall of the rear gas pass and a portion forming the rear wall. Other tubes form a steam generating bank with the vertical gas pass.

Gases from the furnace enter the gas near the top and flow downwardly along the bank of steam generating tubes, and out through the rear wall near the bottom. A plurality of horizontal economizer tubes form an economizer bank with the tubes arranged interspersed between the vertical steam generating tubes and the vertical gas pass.

This superficially appears to be a poor use of the steam generating bank surface since the heat transfer tends to be lower with gas flowing in parallel with the tubes and the gas temperature drop due to the presence of the economizer reduces the heat which can be transferred to the vertical steam generating tubes. The use of the additional steam generating tubing, however, is relatively inexpensive since it simply involves longer lengths of low carbon steel tubing. The number of turns which the gas must make is reduced thereby reducing erosion. The support arrangement for the lower header is simplified since it is supported at a lower elevation. Furthermore, the duct work required for an externally-located economizer is eliminated.

BRIEF DESCRIPTION OF THE DRAWING

The FIGURE illustrates the bottom supported steam generator with horizontal economizer tubes interspersed between the vertical tubes of the steam generating bank.

DESCRIPTION OF THE PREFERRED EMBODIMENT

The steam generator 10 includes a furnace 12 with a traveling grate 14 located below the furnace. A solid fuel such as coal or refuse is distributed on the grate by feeder 16.

The furnace walls are lined with tubes 18, and the entire furnace structure is supported on pedestals 20 from the ground 22. Flue gases from the combustion within the furnace pass upwardly therethrough and horizontally over superheater 24 to opening 26 and downwardly through vertical gas pass 28. The gases pass outwardly through opening 30 to a stack, not shown.

Feedwater enters economizer inlet header 32 and passes through the economizer bank 34 to outlet header 36. The feedwater then passes to steam drum 38 through feedwater line 40.

Steam evaporated in the steam generator passes from steam drum 38 through superheat lines 42 to and through superheater 24 and thence through the main steam line 44.

Water drum 46 is supported on pedestal 48 at an elevation near the lower support of the furnace walls. The supply line 50 connects the water drum to water-wall headers 52.

A plurality of front wall tubes 54 form a front wall of rear gas pass 28 with this wall having opening 26 at the upper end thereof. A plurality of rear wall tubes 56 form the rear wall of the vertical gas pass having opening 30 at the lower end thereof for the egress of flue gas. The tubes at both of these walls are connected at their upper ends to the steam drum 38.

A plurality of vertical tubes 58 are arranged in a plurality of rows connecting the steam drum 38 and the water drum 46. These tubes also operate to support the steam drum from the water drum. These tubes are typically two-inch outside diameter with four-inch longitudinal spacing (from front to back) and seven-inch transverse spacing (across the width of the unit). A plurality of horizontal economizer tubes 60 are interspersed between the vertical tubes 58, forming an economizer bank located above the outlet opening 30 and below the inlet opening 26. These tubes are interconnected in the form of serpentine elements with the return bends being supported on plates 62 which are in turn supported by the front and rear walls of the vertical gas pass. Return bends 64 are located outside of the gas pass thereby avoiding erosion due to high velocity gases between the return bends and the surrounding wall.

These horizontal economizer tubes are arranged with their axes perpendicular to the plane of the front and rear walls of the rear gas pass (but can be oriented perpendicular to the drum) and are typically two-inch OD tubes preferably with vertical fins on the upper and lower portions of each tube. They are spaced on seven-inch centers so that each tube is located half way between adjacent vertical tubes 58, and supported from the front and rear walls. The economizer tubes could alternately be arranged parallel to the plane of the front and rear walls. This arrangement would however, result in a longer unsupported length of tube, and would be more susceptible to temperature unbalance caused by gas maldistribution.

Typically such a steam generator would be operating at a pressure of 100 to 1500 psig and, accordingly, a saturation temperature of 360 to 590 F. The gas temperature entering the economizer section would be in the order of 900 F. and leaving the economizer it would be in the order of 300 to 600 F. It can be seen that the lower portion of vertical tubes 58 which are operating at approximately saturation temperature are relatively ineffective in absorbing any heat from the gases. However, the continuation of these apparently ineffective tubes to the lower drum at the illustrated location produces this simplified economizer and gas flow pattern illustrated.

I claim:

1. A bottom supported steam generator for burning a solid fuel comprising: a steam drum at an upper elevation; a water drum at a lower elevation; means for supporting said water drum from the ground; a plurality of front wall tubes forming a front wall, and a plurality of rear wall tubes forming a rear wall, said walls connecting said steam drum and water drum and forming a vertical gas pass, the front wall having an inlet opening at only the upper end for the ingress of gases and a rear wall having an outlet opening at only the lower end for the egress of gases; a furnace for the burning of fuel therein; steam generating tubes lining the walls of said furnace and connected to said steam drum; means for conducting combustion gases from said furnace to the inlet opening of said vertical gas pass; a plurality of vertical tubes arranged in a plurality of rows within said vertical gas pass, and connecting said steam drum with said water drum, and supporting said steam drum from said water drum; a plurality of horizontal economizer tubes forming an economizer bank and arranged in a plurality of rows, said economizer tubes each interspersed between said vetical tubes at elevations below the inlet opening and above the outlet opening; and means for conveying water from said economizer to said steam drum.

2. A steam generator as in claim 1, wherein said purality of horizontal economizer tubes are arranged with their axes perpendicular to the plane of said front and rear walls.

3. A steam generator as in claim 2 wherein said plurality of economizer tubes are formed as serpentine assemblies with return loops at each end, and said return loops being located outside of said front and rear walls with respect to said vertical gas pass.

* * * * *